US006036915A

United States Patent [19]

Kühne et al.

[11] Patent Number: 6,036,915

[45] Date of Patent: Mar. 14, 2000

[54] WATER-COOLED LADLE HOOD

[75] Inventors: Klaus-Jürgen Kühne, Hünxe; Manfred Schubert, Oberhausen, both of Germany

[73] Assignee: SMS Schloemann-Siemag Aktiengesellschaft, Dusseldorf, Germany

[21] Appl. No.: 09/112,036

[22] Filed: Jul. 8, 1998

[30] Foreign Application Priority Data

Jul. 9, 1997 [DE] Germany ..... 197 29 317

[51] Int. Cl.[7] ..... C21B 7/22

[52] U.S. Cl. ..... 266/158; 373/74; 432/237

[58] Field of Search ..... 266/158, 46; 373/74; 432/237

[56] References Cited

U.S. PATENT DOCUMENTS

| | | | |
|---|---|---|---|
| 4,445,220 | 4/1984 | Kuhlmann | 373/74 |
| 4,813,055 | 3/1989 | Heggart et al. | 373/74 |

FOREIGN PATENT DOCUMENTS

| | | |
|---|---|---|
| 0581203 | 7/1993 | European Pat. Off. . |
| 3147337 | 3/1985 | Germany . |
| 3427086 | 4/1986 | Germany . |
| 4224845 | 2/1994 | Germany . |
| 6-10031 | 1/1994 | Japan . |

*Primary Examiner*—Scott Kastler
*Attorney, Agent, or Firm*—Friedrich Kueffner

[57] ABSTRACT

A water-cooled multipart hood for metallurgical vessels, particularly pouring ladles, with cooling tubes arranged welded tube against tube and/or with gaps between the tubes, with an opening arranged in the cover of the hood for inserting a refractory core piece for guiding electrodes therethrough, and with openings for discharging flue gases. The water-cooled ladle hood further includes a lower outer hood and a lower inner hood with at least three gas exhaust openings and a gas conducting pipe arranged in the lower outer hood, wherein an upper hood with at least three gas exhaust openings, a gas conducting pipe and an opening is arranged in the lower inner hood.

6 Claims, 2 Drawing Sheets

WATER-COOLED LADLE HOOD

BACKGROUND OF THE INVENTION

1. Field of the Invention

The present invention relates to a water-cooled multipart hood for metallurgical vessels, particularly pouring ladles, with cooling tubes arranged welded tube against tube and/or with gaps between the tubes, with an opening arranged in the cover of the hood for inserting a refractory core piece for guiding electrodes therethrough, and with openings for discharging flue gases.

2. Description of the Related Art

In the operation of ladle or pan furnaces for the metallurgical after treatment of steel melts from converters, arc furnaces or the like, the hot and dust-containing waste gases are prevented from being discharged over the ladle rim into the surrounding building by exhausting the waste gases through a pipe connection provided at the ladle hood. In addition to exhausting the waste gases through the openings at the ladle hood, additional exhaust locations are provided at the ladle hood which overlaps the ladle rim of the steel pouring ladle, or the ladle hood is placed on the ladle rim or an additional support device is provided.

DE 31 47 337 C2 discloses a water-cooled hood for metallurgical vessels, particularly-pouring ladles, with collar and cover part, wherein the hood is composed of cooling tubes which are arranged either tightly together or with small gaps therebetween, wherein the cooling tubes are combined to form a meandering cooling water circulation by means of caps placed on the cooling tubes. The collar is essentially composed of vertically extending cooling tubes. The cover part is composed of cooling tubes extending in the circumferential direction, on the one hand, and a self-supporting core piece or heart piece, on the other hand, wherein the core piece has three round electrode passages which are offset relative to each other by 120°, wherein the electrode passages are surrounded by cooling rings composed of a plurality of cooling tubes extending above one another in the circumferential direction of the electrode passages, wherein the cooling rings come together in the center of the cover part and upper support flanges are welded to the outer sides of the cooling rings, wherein the upper support flanges extend with gussets between the electrode passages.

DE 34 27 086 C1 discloses a metallurgical vessel with a heat shield arranged so as to leave a peripheral air gap thereabove, wherein the heat shield has at least one opening through which a probe, lance or electrode is guided from the outside into the interior of the vessel. The metallurgical vessel further has a downwardly open exhaust hood which is placed around the heat shield and surrounds the vessel so as to protrude beyond the peripheral air gap. The air space formed between the heat shield and the exhaust hood is connected to an exhaust device. In order to produce a metallurgical vessel of the above-described type which ensures an exhaust of the process gases and dusts and simultaneously ensures an effective shielding of the ambient air from the metal melt, a separating wall was arranged within the exhaust hood so as to completely outwardly protrude beyond the peripheral air gap, wherein the separating wall forms together with the wall of the exhaust hood an intake nozzle which surrounds the vessel.

DE 42 24 845 A1 discloses a device for sealing a circumferential gap between a steel pouring ladle and the water-cooled ladle hood of a ladle furnace heated by electrodes. This configuration is intended to prevent the large quantity of flue gases, which are formed as a result of a chemical reaction when additives and alloying agents are suddenly added, from unimpededly being discharged into the surroundings. A gas-conducting pipe is mounted at the lower part of the ladle hood. By providing this pipe with a plurality of bores arranged within an angle range of 45° toward the top and toward the bottom, gas is discharged from this pipe with excess pressure and forms a gas veil for sealing the gap between the steel pouring ladle and the water-cooled ladle hood.

The ladle hoods described above have the disadvantage that the sealing effect at the outer cover area for the passage of lances or electrodes is insufficient and the exhaust of the hot flue gases in the upper part of the ladle hood is not satisfactory.

SUMMARY OF THE INVENTION

Therefore, it is the primary object of the present invention to further develop the water-cooled ladle hood of the type described above in such a way that a specifically targeted exhaust of the waste gases can be carried out simultaneously at various locations of the water-cooled ladle hood.

In accordance with the present invention, the water-cooled ladle hood includes a lower outer hood and a lower inner hood with at least three gas exhaust openings and a gas conducting pipe arranged in the lower outer hood, wherein an upper hood with at least three gas exhaust openings, a gas conducting pipe and an opening is arranged in the lower inner hood.

In contrast to the previously known ladle hoods, the water-cooled ladle hood according to the present invention provides the advantage that the flue gases are exhausted at least at three locations and in two planes. The ladle hood is composed of an outer and an inner tube cylinder, i.e., the lower hood part which is divided by vertically arranged cooling tubes which protrude downwardly beyond the rim of the ladle on the outside as well as on the inside.

In the lower area of the hood which is lowered directly over the melt in the ladle, the flue gases are collected by the lower part of the water-cooled hood and are exhausted in a specifically targeted manner in the upper part at three locations in the areas of the electrodes. The gas flows are joined on the outside in the area of the transition to the stationary waste gas pipe. The proportion of the exhausted flue gas quantities through this lower inner hood part is about 80% of the total quantity and its temperature is in a range of between 1200° C. and 1400° C.

Another exhaust area is located in the upper part of the hood, the so-called secondary hood. This hood part is constructed in such a way that as little flue gases as possible can penetrate into this area because the vertical cooling tube wall also protrudes out in a circular configuration. As is the case in the lower hood part, the flue gases arriving in the upper part are exhausted in a specifically targeted manner in the area of the electrodes at three locations.

These three openings in the secondary hood are dimensioned in such a way that approximately the same exhaust quantity is exhausted at all three exhaust locations. By mounting screens it is additionally possible to adapt within a limited volumetric area the flue gas quantity to be exhausted to the actual operating conditions of the furnace plant.

Accordingly, the openings in the cylindrical part of the upper hood part ensure that a uniform exhaust takes place. Also in this case, the gas flows are joined outside in the area of the transition to the stationary waste gas pipe. In order to prevent flue gases from gushing out through the three annular gaps between the electrodes and the refractory material of the core piece and to keep the negative pressure in the lower exhaust area as small as necessary, the negative pressures in the two exhaust planes are adjusted separately. The proportion of the gas quantity exhausted through the secondary hood or upper hood part is about 20% of the total quantity and its temperature is in a range of between 600° C. and 1200° C.

The entire hood is water-cooled and constructed by welding tube against tube and/or partially with gaps between the tubes, wherein the water-cooled work door is opened and closed pneumatically. Hand lances are used for determining the temperature and taking samples of the melt through this work door. The alloying gate is also closed and opened pneumatically. In the opened state, an air veil in the drop pipe prevents large quantities of flue gas from escaping.

The gate for additives and alloys is installed as a water-cooled connection. This water-cooled connection is mounted in a dust-tight manner in the ladle hood.

The refractory core piece for the electrode passages is supported by a replaceable water-cooled ring composed of three tubes which are arranged one above the other. A gap width of equal to or smaller than 25 mm between the electrodes and the rammed material of the core piece is desired in order to keep the gas passage or inleaked air within limits.

The cooling water supply is effected through pipelines with flexible compensators and their distributors. Cooling cycles are provides for the ladle hood according to the present invention. In addition, two cooling cycles are provided for the end connection of the alloying gate and for the water-cooled ring of the core piece.

In order to achieve an improved synchronous travel of the hood during lifting movements, three cover lifting cylinders are installed in the cover lifting device. The synchronous travel of the ladle hood is achieved through three current regulating valves.

The upper end position of the ladle hood is monitored at each cylinder. The hydraulic valve for the lifting movements of all cylinders is only switched off after all cylinders have reached their end positions. Lowering of the hood then always takes place from the same initial position. The mechanical connection of the hydraulic cylinders takes places through a stationary furnace platform.

In the work position, the inner tube cylinder of the ladle hood projects into the pouring ladle, and the outer tube cylinder is positioned over the ladle rim outside of the pouring ladle.

When smaller pouring ladles with less capacity are used, the inner tube cylinder can also be placed directly on the ladle rim.

When using pouring ladles having a small capacity and a ladle diameter which is smaller than the inner tube cylinder of the hood, the inner tube cylinder of the hood is lowered over the ladle rim. In that case, the hood is freely suspended in the cover lifting device or it is supported on brackets attached to the outer sides of the ladle or on reinforcement collars below the upper hood of the ladle.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
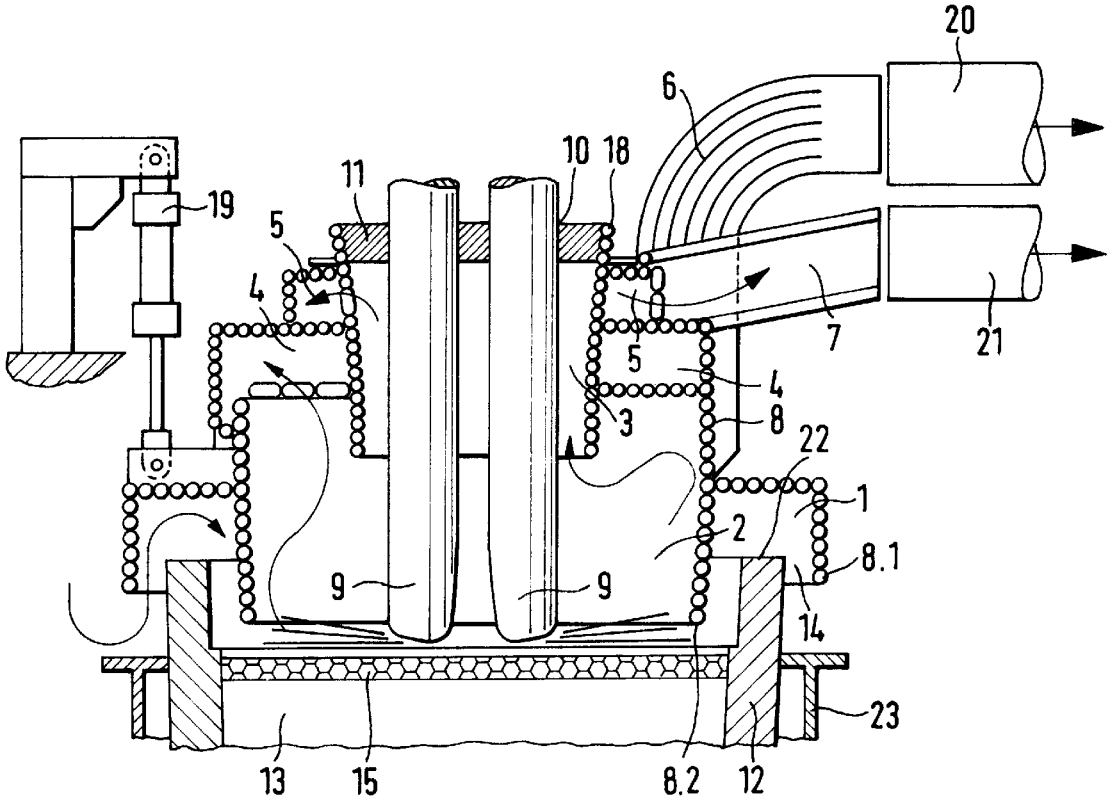
FIG. 1 is a side view, partially in section, of the water-cooled ladle hood according to the present invention.

FIG. 1 of the drawing shows the water-cooled ladle hood according to the present invention in the operating position thereof. The ladle hood is arranged above a steel pouring ladle 12 filled with a melt, wherein the electrodes 9 are lowered into the so-called heating position through the refractory material 11 of the water-cooled core piece 18.

The water-cooled ladle 1, 2, 3 is composed of cooling tubes 8 which are welded tube against tube or with gaps between the tubes. The cooling tubes 8 are arranged vertically one above the other or horizontally next to one another.

The lower outer hood part 1 and the lower inner hood part 2 are positioned immediately above the upper ladle rim 22 and are fastened through support arms of the cover lifting device 19 to the cooling walls 8. The cooling tubes 8 of the upper hood part 3 are placed within the inner hood part 2. The inner tube cylinder 8.2 of the inner hood 2 has a greater length than the outer tube cylinder 8.1 of the outer hood 1.

The hot flue gases are exhausted through exhaust openings 4 and to a first gas conducting pipe 6 and are conducted from there to a primary dust removal 20. The flue gases that are less hot are exhausted through exhaust openings 5 into a second gas conducting pipe 7 and are conducted from there to an auxiliary dust removal 21. Fresh air can be taken in through an intake opening 14 above the ladle rim 23. The refractory material 11 of the core piece 18 is arranged in an opening 10 between the water-cooled rings of the core piece 18. A swing-type cooled work door 16 is arranged at the transition from the horizontal and vertical cooling tubes 8 in the upper part of the inner tube cylinder 8.2. In the work position, the ladle hood 1, 2 can be lowered onto the reinforcement collars 23 or brackets mounted on the pouring ladle 12.

Figure 2:
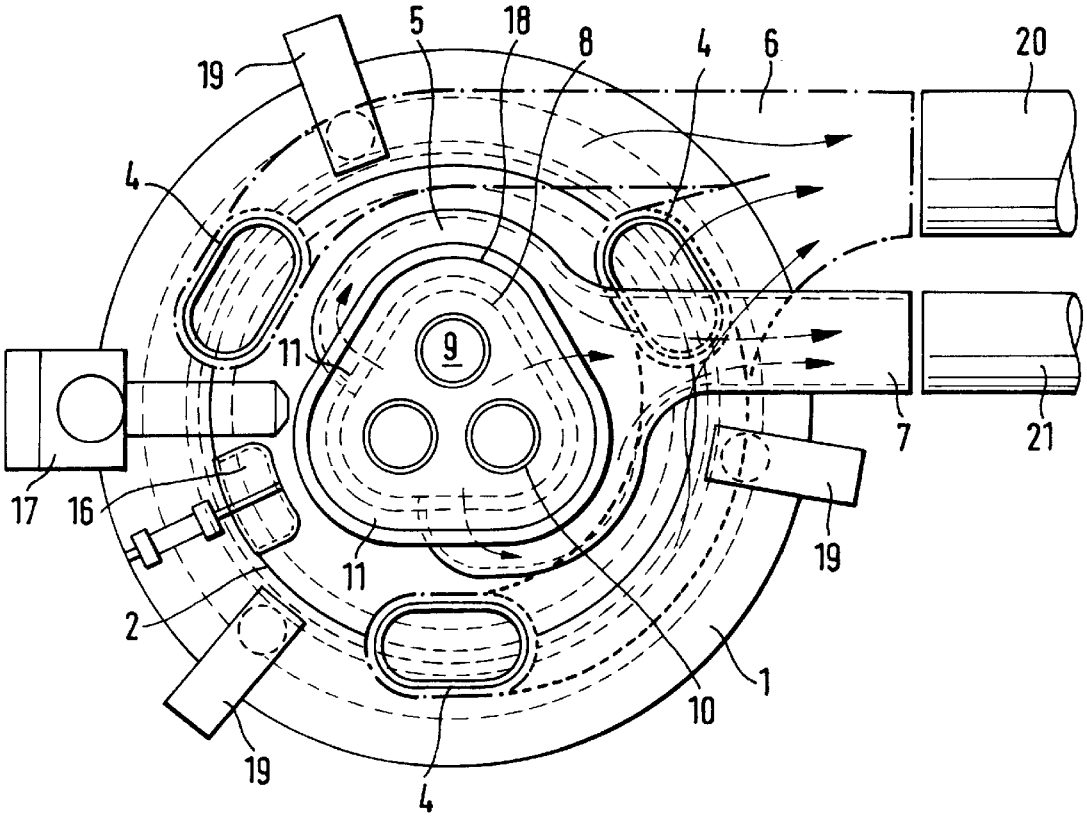
FIG. 2 is a top view of the ladle hood of FIG. 1.

FIG. 2 is a top view of the water-cooled ladle hood 1, 2 with an opening 10 arranged in the center and a water-cooled ring 18, which, together with the upper cooling tube wall 8 serves as a support for the refractory material 11 through which the electrodes 9 slide.

The lower exhaust openings 4 are connected to the gas conducting pipe 6, and the exhaust openings 5 of the upper hood part 3 are connected to the gas conducting pipe 7, wherein the gas conducting pipe 6 is connected to a primary dust removal 20 and the gas conducting pipe 7 is connected to an auxiliary dust removal 21.

A lance, not shown, for temperature measurement or sample removal can be introduced through the open work door 16, while additives and alloying agents are introduced through a water-cooled gate 17 into the pouring ladle containing melt. The ladle hood 1, 2 is releasably fastened on three support arms of the cover lifting device 19.

While specific embodiments of the invention have been shown and described in detail to illustrate the inventive principles, it will be understood that the invention may be embodied otherwise without departing from such principles.

We claim:

1. A water-cooled multipart hood for metallurgical vessels, the hood being comprised of cooling tubes welded at least one of tube against tube and with gaps between tubes, further comprising a cover for the hood and a refractory core piece placed in an opening arranged in the cover of the hood, the hood comprising a lower outer hood, a lower inner hood with at three gas exhaust openings and a gas conducting pipe mounted in the lower outer hood, and an upper hood with at least three gas exhaust openings, a gas conducting pipe and an opening mounted in the lower inner hood.

2. The hood according to claim 1, wherein the gas conducting pipe of the lower inner hood is adapted to be connected to a primary dust removal and the gas conducting pipe of the upper hood is adapted to be connected to an auxiliary dust removal.

3. The hood according to claim 1, wherein the lower inner hood and the lower outer hood are cylindrical, wherein the cylindrical lower inner hood has a greater length than the cylindrical lower outer hood.

4. The hood according to claim 1, further comprising a cover lifting device, and wherein the multipart hood is fastened so as to be suspended at three points at the cover lifting device.

5. The hood according to claim 1, wherein the lower inner hood comprises a water-cooled gate for additives.

6. The hood according to claim 1, wherein the lower inner hood has horizontally and vertically extending walls, and wherein a swing-type, water-cooled work door is arranged at a transition between the horizontal and vertical walls.

* * * * *